US010228203B2

(12) United States Patent
Schneider

(10) Patent No.: US 10,228,203 B2
(45) Date of Patent: Mar. 12, 2019

(54) CASE DISCHARGE DEVICE

(71) Applicant: RHEINMETALL WAFFE MUNITION GMBH, Unterluess (DE)

(72) Inventor: Hubert Schneider, Dietingen (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 0 days.

(21) Appl. No.: 15/867,239

(22) Filed: Jan. 10, 2018

(65) Prior Publication Data

US 2018/0149439 A1 May 31, 2018

Related U.S. Application Data

(63) Continuation of application No. PCT/EP2016/065853, filed on Jul. 5, 2016.

(30) Foreign Application Priority Data

Jul. 10, 2015 (DE) ..... 10 2015 008 797

(51) Int. Cl.
*F41A 15/16* (2006.01)

(52) U.S. Cl.
CPC ..... *F41A 15/16* (2013.01)

(58) Field of Classification Search
CPC ..... F41A 15/16
USPC ..... 42/25
See application file for complete search history.

(56) References Cited

U.S. PATENT DOCUMENTS 3,882,625 A * 5/1975 Tellie ..... F41A 3/12 42/25
4,265,043 A * 5/1981 Rowlands ..... F41A 15/14 42/25
4,269,108 A 5/1981 Stoner
4,272,902 A * 6/1981 Waters ..... F41A 15/14 42/25
4,899,477 A 2/1990 Aigner
4,942,802 A * 7/1990 Stoner ..... F41A 9/32 42/25
5,608,981 A * 3/1997 Canaday ..... F41A 15/16 42/25
6,349,495 B1 * 2/2002 Fluhr ..... F41A 17/66 42/25

(Continued)

FOREIGN PATENT DOCUMENTS

DE 3038769 C2 12/1988
DE 10 2005 003 751 B3 7/2006

(Continued)

*Primary Examiner* — Joshua E Freeman
(74) *Attorney, Agent, or Firm* — Muncy, Geissler, Olds & Lowe, P.C.

(57) ABSTRACT

A case discharge device having a case ejector for ejecting a case or a misfire for a weapon having a bolt with a bolt head, wherein a munition is supplied to a weapon barrel of the weapon by the bolt and the case or the misfire is pulled out of the weapon barrel. The case discharge device is characterized in that, now, in the bolt head, there is situated a groove into which a case ejector which is static with respect to a weapon housing engages. During the return of the bolt, the case ejector which is static with respect to the weapon housing slides within the groove and engages on the bottom of the case in order to release the latter from the bolt and, after the release, discharge said case.

9 Claims, 5 Drawing Sheets

(56) References Cited

U.S. PATENT DOCUMENTS

| | | | | |
|---|---|---|---|---|
| 6,389,725 | B1 * | 5/2002 | Denuit | F41A 9/56 42/25 |
| 6,625,917 | B2 * | 9/2003 | Murello | F41A 3/26 42/16 |
| 8,726,779 | B2 | 5/2014 | Buhl et al. | |
| 9,835,397 | B2 * | 12/2017 | Stussak | F41A 15/12 |
| 2011/0168009 | A1 | 7/2011 | Robb et al. | |
| 2014/0075807 | A1 * | 3/2014 | Lewis | F41A 15/14 42/25 |
| 2014/0090283 | A1 * | 4/2014 | Gomez | F41A 3/26 42/25 |
| 2014/0137454 | A1 * | 5/2014 | Lee | F41A 15/14 42/25 |
| 2014/0223789 | A1 * | 8/2014 | Kramer | F41A 5/18 42/25 |
| 2015/0369553 | A1 | 12/2015 | Stussak | |
| 2017/0198999 | A1 * | 7/2017 | Goddard | F41A 15/16 |
| 2018/0087857 | A1 * | 3/2018 | Davis | F41A 5/02 |

FOREIGN PATENT DOCUMENTS

| | | | |
|---|---|---|---|
| DE | 10 2007 034 672 | A1 | 1/2009 |
| DE | 10 2009 056 735 | A1 | 6/2011 |
| DE | 10 2013 003 435 | A1 | 8/2014 |

* cited by examiner

CASE DISCHARGE DEVICE

This nonprovisional application is a continuation of International Application No. PCT/EP2016/065853, which was filed on Jul. 5, 2016, and which claims priority to German Patent Application No. 10 2015 008 797.5, which was filed in Germany on Jul. 10, 2015, and which are both herein incorporated by reference.

BACKGROUND OF THE INVENTION

Field of the Invention

The present invention relates to a casing discharge device having a casing ejector, i.e. a device for ejecting a munition casing or a dud from a weapon. The munition is fed with linear feeding by a breech drive which introduces the munition/shell into a shell chamber of the weapon barrel.

Description of the Background Art

The breech drive of such a weapon is preferably linear and rectilinear and has idle times of the breech. In the front position (front idle time), the shot is fired, and in the rear position (rear idle time), the weapon is loaded. To this end, a munition/shell to be fired is presented to the breech during the loading of the weapon. This munition is then pushed by the breech into the shell chamber of a weapon barrel and the breech with the weapon chamber locked. After the munition has been fired, the weapon is unloaded, to which end the empty casing or, in the case of a dud, said dud is extracted from the shell chamber via a shell extractor during the return of the breech. A breech drive of this kind is disclosed for example by DE 10 2009 056 735 A1, which corresponds to U.S. Pat. No. 8,726,779, which is incorporated herein by reference.

DE 30 38 769 C2, which corresponds to U.S. Pat. No. 4,269,108, discloses a shell casing extraction device for automatic firearms. After a shot has been fired, the shell casing is extracted from the shell chamber by the breech during the return movement of the breech. DE 10 2007 034 672 A1, too, describes a breech and an extraction claw that acts on a shell bottom edge.

After being extracted, the shells or a dud are placed for example in a rotor or an ammunition belt link or the like. Subsequently, the casing or the dud is transported out of the weapon.

DE 10 2005 003 751 B3 discloses a casing collecting device for belt-link-free ammunition. Said document proposes, for returning the casings into an ammunition container, incorporating a casing guide in the form of a discharge tube and to orient the latter such that the casings come to rest in the chain links.

Extraction and discharge devices of this kind require a relatively large amount of space within the weapon.

SUMMARY OF THE INVENTION

It is therefore an object of the present invention to provide a casing ejector for a small weapon, said casing ejector also allowing good reproducibility of ejection.

In an exemplary embodiment, the invention is based on the idea of saving space by integrating the casing ejector at the breech, preferably at/in the chamber of the breech (referred to as breech head below). In addition, the extraction of the casing/dud and the ejection are combined with one another such that the two sequences of "extraction" and "ejection" take place one directly after the other.

A casing extractor is fitted preferably at the front end of the breech head. A casing ejector fixed to the weapon housing has the object of ejecting the casing, or dud, conveyed out of the weapon barrel by the casing extractor, out of the weapon, preferably laterally, after the casing/dud has been extracted. These can then be collected in a collection vessel incorporated in the ejection path. Alternatives are likewise possible.

In an embodiment, the breech head has a slot. The latter is incorporated along the entire length of the breech head. The casing ejector fixed to the weapon engages in this slot with its face, such that the casing ejector is incorporated therein in a sliding manner. The diameter of the face of the casing ejector and the slot are coordinated with one another. The end side of this face forms the point of engagement of the casing ejector with the casing (still to be carried out). The slot is integrated into the breech head such that the casing extractor and the casing ejector cannot disrupt or impede one another in terms of their functions. Therefore, the slot is preferably incorporated in the breech head opposite the arrangement of the casing extractor on the breech head. When the breech head is located in its front position, the casing ejector is located at the rear end in the slot. If the breech, or the breech head, is guided toward the rear into its rear position, the breech head with its slot slides along the fixed casing ejector. As soon as the front end of the breech head has reached the casing ejector at its front face, i.e. at its end side, the casing ejector acts on the casing bottom and pushes the casing in a particular position preferably laterally away from the breech or breech head.

For good reproducibility of ejection, in a development of the invention, the shape of the casing ejector was optimized. Thus, the face of the casing ejector has at least one recess, thereby forming a step on the end side of the casing ejector. The recess is in this case determined by the diameter of the casing. The face acting on the casing bottom is then no longer the front end face of the casing ejector, but rather the rear face of the recess or step. By way of this recess or step, a lateral holder for the casing is formed at the same time, when the breech with a casing is moved toward the rear. The length of the step is freely selectable. However, it should preferably be selectable such that it forms an optimum holder for the casing during the extraction and ejection process. This adapted shape of the casing ejector thus determines the discharging characteristics of the casing. As a result of the adapted shape, the discharge position within the weapon and thus with respect to the breech head is precisely defined. The casing is discharged preferably when the drive and the breech movement slow down within the "unloading" firing cycle.

At the transition to the rear face of the recess or step, a slight slope is preferably provided, which supports ejection by levering the casing away from the breech head. At this time, the breech is in its rear position, deactivated. By way of the last levering part of the casing ejector, a sufficiently large amount of energy is imparted on the casing such that the casing is ejected from the weapon without any additional measures/force.

Proposed is a casing discharge device having a casing ejector for ejecting a casing or a dud for a weapon having a breech with a breech head. In this case, the munition is fed to a weapon barrel of the weapon through the breech and the casing or the dud are extracted from the weapon barrel. The novel casing discharge device is distinguished by the fact that there is now a slot in the breech head, a casing ejector fixed to the weapon housing engaging in said slot. The casing ejector fixed to the weapon housing slides within the slot during the return of the breech and as a result acts on the casing bottom of the casing in order to release the latter from the breech and eject it from the breech together with the releasing or during the releasing.

As a result of the stationary routing with the aid of the casing ejector fixedly integrated in the weapon housing, defined, cadence-independent discharge conditions are created. In addition, only one empties routing is necessary, which for its part can work reliably on account of the unvarying discharge conditions.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
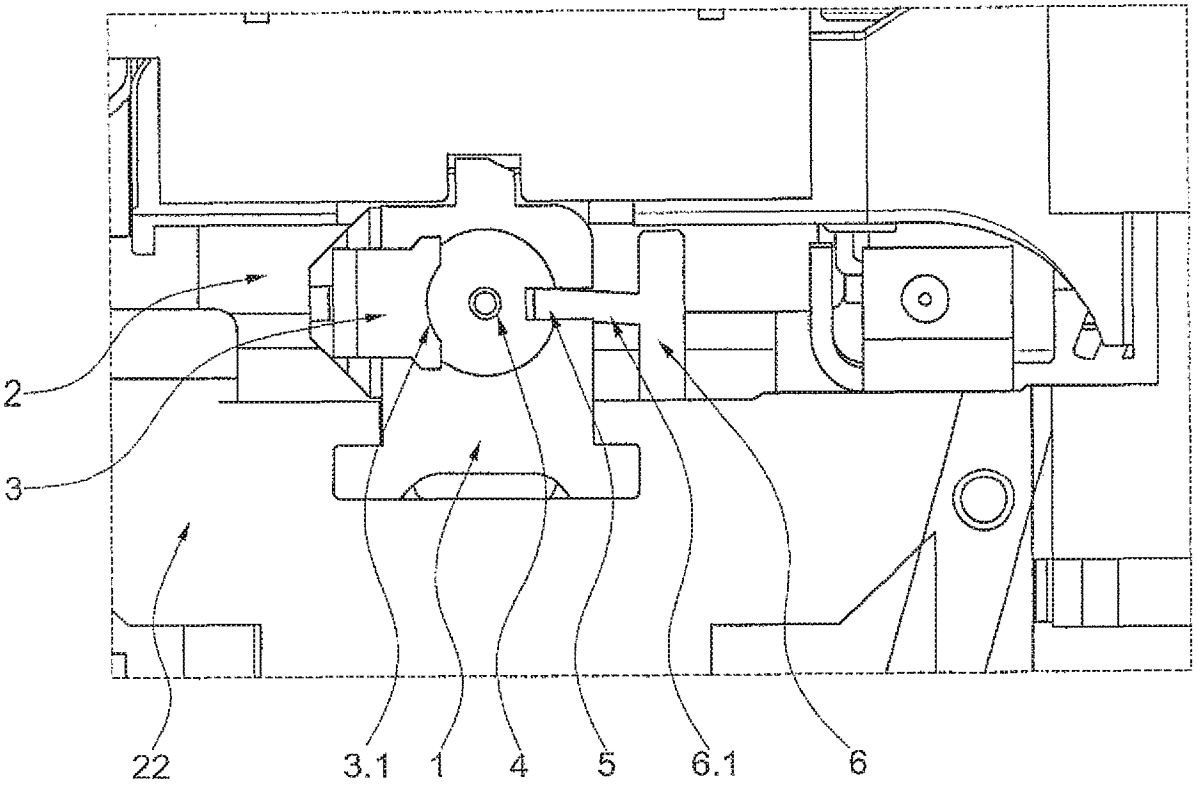
FIG. 1 shows a plan view of a breech head according to the invention.
Figure 2:
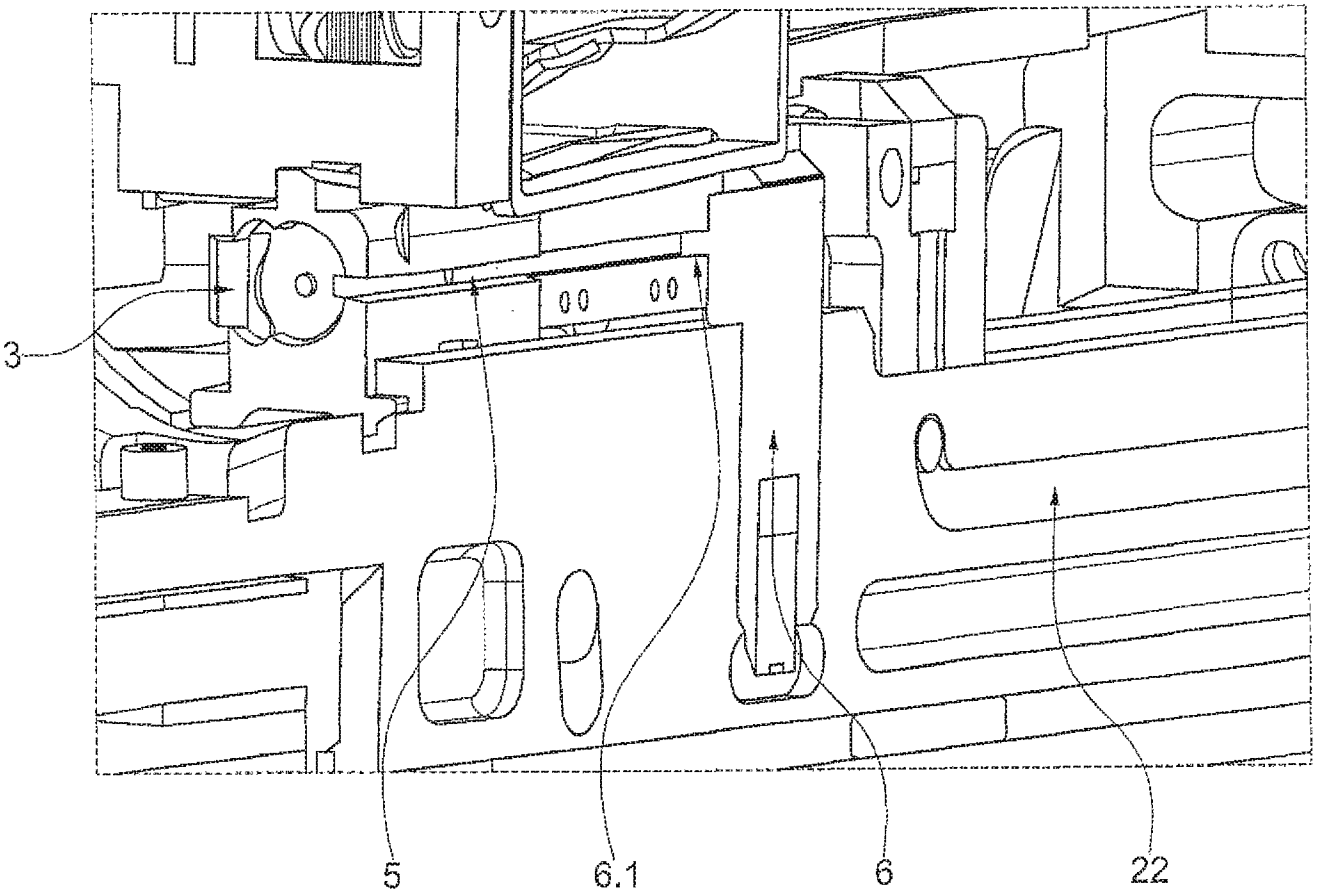
FIG. 2 shows a perspective illustration of the breech head in FIG. 1.
Figure 3:
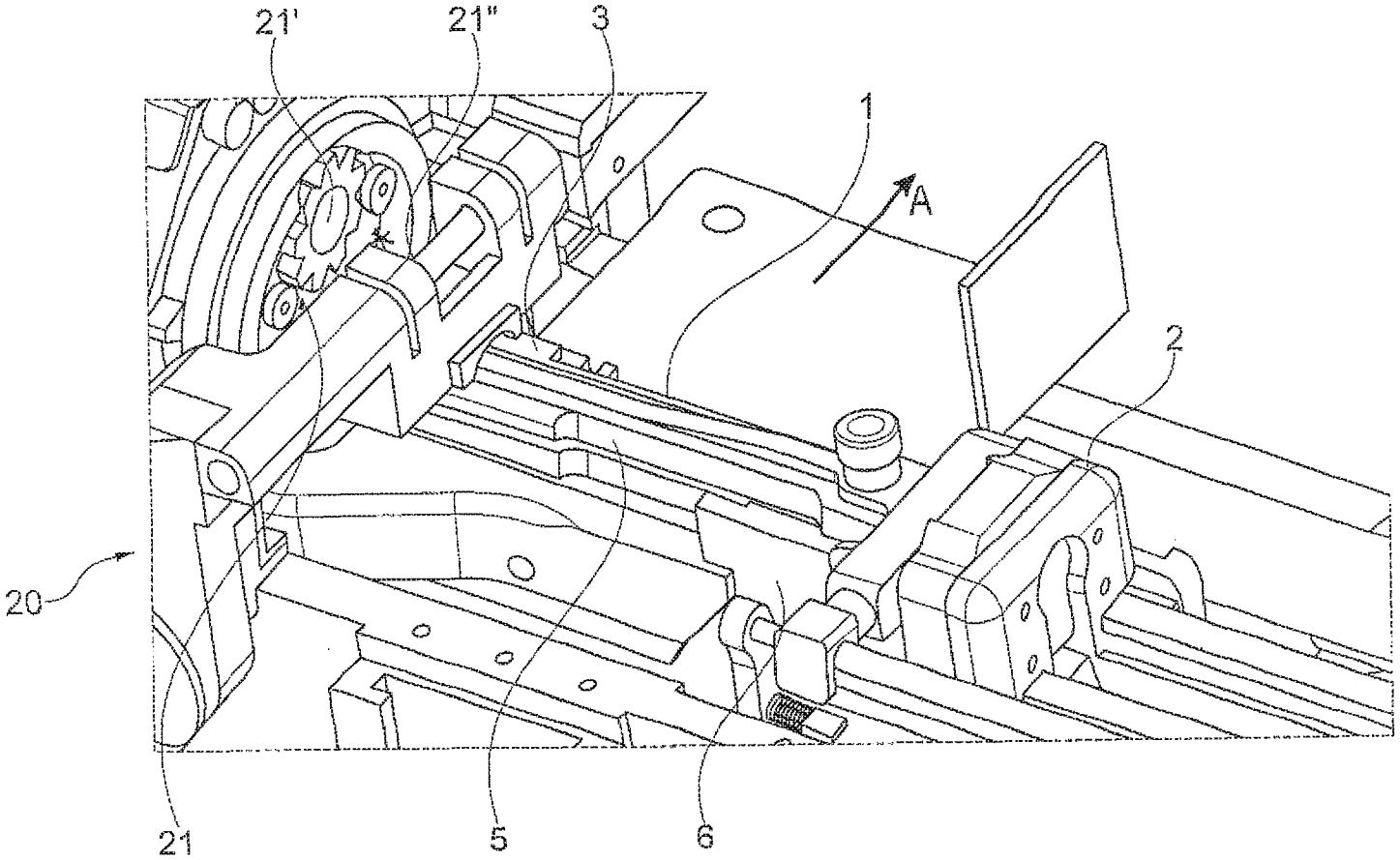
FIG. 3 shows a perspective plan view of the breech head and the casing ejector.

In FIGS. 1-3, a breech head of a breech 2 is identified by 1. The breech head 1 and the breech 2 are mounted in a weapon housing 22 and are guided therein. A casing extractor 3 is incorporated at the front end of the breech head 1, preferably laterally, in this case on the right-hand side as seen in the firing direction. The casing ejector 3 preferably has a semicircular flat shape 3.1. As a result, optimum engagement with a casing bottom 10, illustrated schematically in FIGS. 4 and 5, of a casing 11 is ensured. In operation, the casing extractor 3 acts on a groove 10.1 in the casing bottom 10 in order to extract the casing 11 in a known manner. The casing extractor 3 is preferably spring-mounted in the breech 2 or on the breech head 1. A firing pin 4 positioned centrally in the breech head 1 is only indicated in this case.

A slot 5 is introduced into the breech head 1 laterally, on the left-hand side as seen in the firing direction and opposite the casing extractor 3. This slot 5 extends preferably along the entire length of the breech head 1. In this groove 5, a casing ejector 6 that is fixed to the weapon or is fixedly connected to the weapon housing 22 is guided. Said casing ejector 6 projects laterally into the slot 5 with its lug or its face 6.1.

FIG. 3 illustrates a plan view of the weapon-side incorporation of the casing ejector 6, wherein the breech 2 is still in its locked (front) position. The ejection direction of the casing 11 (not illustrated in more detail here) is indicated with A. FIG. 3 also shows the incorporation of the casing discharge device with the casing ejector 6 and the casing extractor 3 in an only partially illustrated weapon 20. This weapon 20 has a barrel bundle with a plurality of weapon barrels 21, 21', 21" (only indicated), wherein only one weapon barrel 21 is locked with the breech 2 when a shot is fired. Provision is not made here for the weapon barrel 21, 21', 21" to be changed after every shot. Rather, a barrel change takes place when the weapon barrel 21 drops below a predetermined temperature, for example, (barrel wear) or a firing condition is determined (dud; lack of weapon recoil on account of a lack of firing) etc.

The illustration chosen here shows what is known as the transport position, in which none of the weapon barrels 21, 21', 21" is in front of the breech and the latter is also not tensioned. As a result, the transport safety is increased.

The casing ejector comprises a face 6.1 which engages in the slot 5. The diameter or the height/thickness of the face 6.1 and also the face 6.1 itself is coordinated with the width and depth of the slot 5. In the preferred embodiment according to FIGS. 4 and 5, this face 6.1 has a recess 6.2, which for its part is coordinated with the diameter of the casing 11. By way of the recess 6.2, a lateral face 6.3 is formed on the casing ejector 6, said lateral face 6.3 serving to securely hold the casing 11 before the actual ejection during the breech movement toward the rear. A slope 6.4 then supports the ejection of the casing 11.

Figure 4:
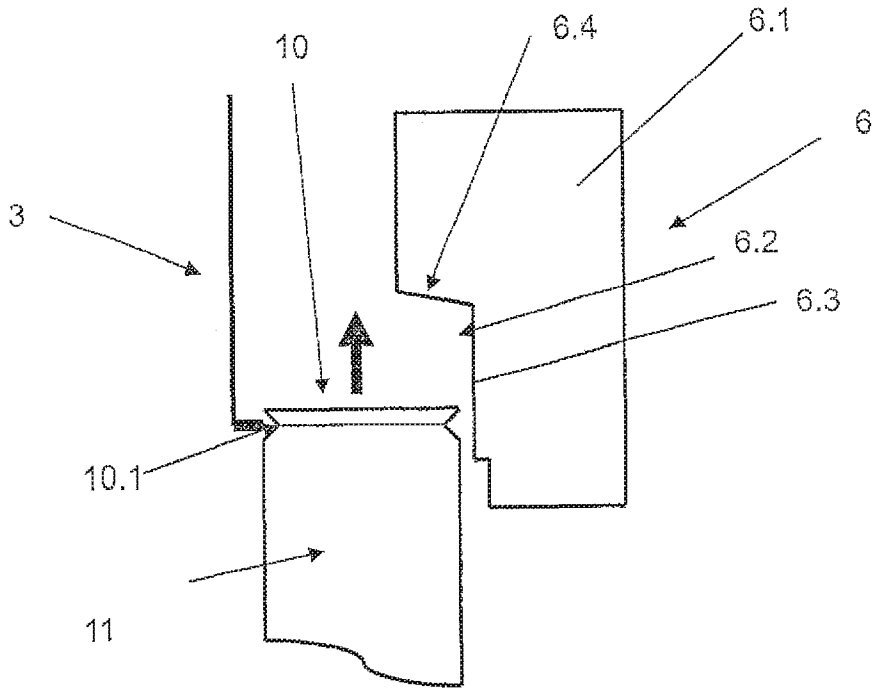
FIGS. 4 and 5 show an illustration of the casing ejection in a (schematic) plan view without a breech head.
Figure 5:
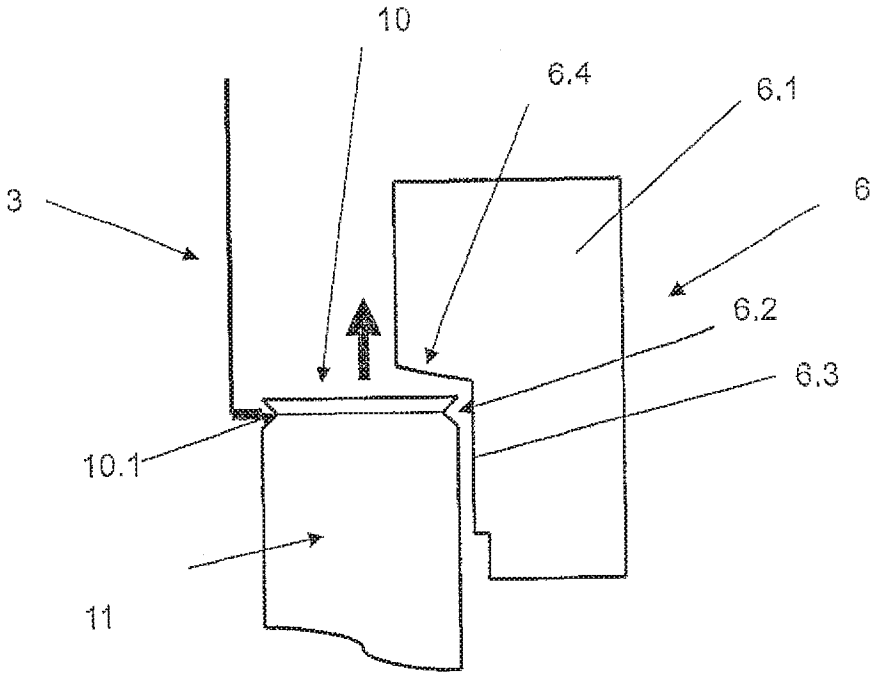

The sequence of casing ejection can be described as follows:

During its forward movement, the breech head 1 carries along a munition (not illustrated in more detail) and guides the latter into the shell chamber of a weapon (not illustrated in more detail). In the process, the breech head 1 is guided along the (stationary) casing ejector 6 fixed to the housing and carries along the munition. The casing ejector 6 is located at the rear stop of the slot 5 (FIG. 3) when the breech 2 is locked in its front position with the weapon barrel 21. After a shot has been fired, the breech 2 and breech head 1 are moved toward the rear, the casing (dud) is also moved out of the weapon barrel 21 in a known manner by the casing extractor 3 at the breech head 1. As the breech head 1 slides back, the latter slides with its slot 5 along the recess 6.1, wherein the casing 11 also passes into this region of the casing ejector 6 (FIG. 4). The lateral face 6.3 of the casing ejector 6.1 encloses the casing 11 on one side and in a somewhat planar manner 6.3, corresponding to the thickness of the casing ejector 6. As a result of further movement of the breech head 1 (FIG. 5), the rear slope 6.4 now acts on the casing bottom 10 and pushes the casing 11 in the opposite direction A, i.e. to the right as seen in the firing direction. In the process, the casing 11 is tilted away, such that the casing extractor 3 slides out of the groove 10.1.

A new shell can be presented to the breech head 1.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A casing discharge device comprising:

a casing ejector for ejecting a casing having a casing bottom or for ejecting a dud for a weapon, the weapon having a breech and a breech head, via which a munition is fed to a weapon barrel of the weapon and the casing or the dud is extracted from the weapon barrel; and a slot arranged in the breech head;

wherein the casing ejector is fixed to a weapon housing of the weapon and engages in the slot in the breech head, wherein the casing ejector slides within the slot during a return of the breech and the breech head such that the casing ejector is adapted to act on the casing bottom of the casing to discharge the casing, wherein the casing ejector has a lug which engages in the slot, wherein a diameter of the lug is coordinated with a width and depth of the slot, and wherein a recess in the form of a step is provided in a face of the lug that is directed towards the slot, the recess configured to hold a portion of a side of the casing and a portion of the casing bottom therein during discharge of the casing.

2. The casing discharge device as claimed in claim 1, wherein the slot extends along an entire length of the breech head.

3. The casing discharge device as claimed in claim 1, wherein the recess is coordinated with a diameter of the casing.

4. The casing discharge device as claimed in claim 1, wherein the lug includes a lateral face, the lateral face being a base surface of the recess, the lateral face serving to hold the portion of the side of the casing.

5. The casing discharge device as claimed in claim 4, wherein the lug includes a slope face, the slope face forming a transition surface from the face of the lug to the lateral face of the recess of the lug.

6. A weapon having a casing discharge device as claimed in claim 1.

7. The weapon as claimed in claim 6, wherein a casing extractor is spring-mounted at the breech and engages in a groove in the casing bottom in order to extract the casing from the weapon barrel.

8. The weapon as claimed in claim 7, wherein the casing extractor has a semicircular face which engages in the groove in the casing bottom.

9. The casing discharge device as claimed in claim 5, wherein the portion of the casing bottom contacts the slope face.

* * * * *